United States Patent [19]

Penoza

[11] Patent Number: 5,069,872

[45] Date of Patent: Dec. 3, 1991

[54] CUTTING TOOL

[76] Inventor: Frank J. Penoza, 201 Pine Knoll Cir., Autumn Hills, Del. 19707

[21] Appl. No.: 404,777

[22] Filed: Sep. 8, 1989

[51] Int. Cl.[5] ..... G22F 3/00

[52] U.S. Cl. ..... 420/436; 420/440; 428/552; 501/87; 30/350

[58] Field of Search ..... 420/435, 436, 440, 580, 420/583, 584, 585, 431; 30/350; 501/87, 46, 93; 75/228, 248, 428; 428/548, 551, 552, 553, 550, 564

[56] References Cited

U.S. PATENT DOCUMENTS

| | | | |
|---|---|---|---|
| 2,122,403 | 7/1938 | Balke et al. | 148/905 |
| 2,191,446 | 2/1940 | Balke et al. | 420/436 |
| 2,309,371 | 1/1943 | Wissler | 420/436 |
| 2,801,165 | 7/1957 | Baldwin et al. | 420/440 |
| 3,451,791 | 6/1969 | Meadows | 501/87 |
| 4,868,065 | 9/1989 | Maruyama et al. | 428/552 |

FOREIGN PATENT DOCUMENTS

| | | | |
|---|---|---|---|
| 1231084 | 5/1971 | United Kingdom | 501/87 |

*Primary Examiner*—R. Dean

*Assistant Examiner*—Sikyin Ip

*Attorney, Agent, or Firm*—Mortenson & Uebler

[57] ABSTRACT

An improved cutting tool is provided, especially useful for hand shears. The cutting edge of the tool is made of a wear-resistant material of either: (a) 85% to 96% tungsten carbide and 15% to 4% cobalt, (b) 60% to 89% tungsten carbide, 4% to 28% tantalum carbide, 4% to 25% titanium carbide and 3% to 30% cobalt, or (c) 34% to 51% cobalt, 25% to 32% chromium, 14% to 21% tungsten, 2% to 4% carbon and one or more of the metals nickel, silicon, columbium, manganese and iron which, together, comprise no more than 16% of the material. For material "b", preferably the composition contains about 5% to 13% cobalt, 65% to 89% tungsten carbide, titanium carbide and tantalum carbide which, together, are present in an amount no greater than 30% of the composition of the material. For material "c", preferably the composition contains about 28% to 32% chromium, 43% to 48% cobalt, tungsten and one or more of nickel, silicon, iron, manganese, columbium and carbon which, together, are present in an amount no greater than 29% of the composition of the material.

5 Claims, 1 Drawing Sheet

CUTTING TOOL

BACKGROUND OF THE INVENTION

The invention relates to an improved wear-resistant composition of materials used for cutting edges of cutting tools. The composition according to the invention can be used on virtually any cutting tool, but, for convenience herein, reference will be made to hand shears.

Conventional techniques for cutting high-strength fibers or fabrics have many problems. Presently, hand shears are made of low carbon steels or tool steels which are heat-treated to form a hard cutting edge. A problem with such tools is that the cutting edges become dull very quickly, and require frequent regrinding, which reduces the hardness and the cutting edge durability is even further reduced.

A hand shear made of zirconia or zirconium oxide has been developed. This shear is very brittle and susceptible to chipping during edge grinding, and is known to shatter into fragments if dropped on a hard substance.

Another known shear consists of a mechanically held, throw-away insert attached to a holder that forms the cutting edge. Misalignment in such a device results in poor cutting.

While the above devices are capable of cutting many low-strength materials, they fail to provide precise blade alignment and blade edge continuity required to cut high-strength fibers such as glass, carbon and aromatic polyamide fibers, and are, therefore, difficult to use and are economically not feasible for such high-strength fibers.

These prior devices employ a relatively low carbon steel that quickly loses hardness during regrinding or, alternatively, they employ a hard, brittle ceramic that is difficult to grind. Also, the cutting edge achieved in these devices is of poor quality relative to the sharpness and durability required to sever the high-strength fibers and fabrics mentioned above.

Conventional hand shears are typically manufactured using old manufacturing techniques which leaves much to be desired when considering both cost and product quality.

Objects of the invention include a tool having a cutting edge of high hardness, low coefficient of friction and extended life edge, a superior cutting edge relative to prior art devices which is economically feasible for commercial production, a hand shear which exhibits superior quality relative to the hardness and coefficient of friction of the cutting edge, a tool of the type described wherein the chemical composition of the ingredients are efficiently combined to provide a superior cutting edge, a tool of the type described wherein the chemical combination of the ingredients can be proportioned to provide a tough cutting edge, or to provide a harder cutting edge or a combination of toughness and hardness, and a device of the type described which permits the manufacture of hand shears employing superior materials for the cutting edge than heretofore practical.

SUMMARY OF THE INVENTION

A wear-resistant cutting tool is provided having a cutting edge made of 85% to 96% tungsten carbide and 15% to 4% cobalt, or, alternatively, a composition comprising 60% to 89% tungsten carbide, 4% to 28% tantalum carbide, 4% to 25% titanium carbide, and 3% to 30% cobalt. The cutting tool composition preferably comprises 65% to 89% tungsten carbide, 5% to 13% cobalt, and titanium carbide and tantalum carbide which, together, are present in an amount no greater than 30% of the composition. The cutting tool may be a pair of hand shears, a knife or similar tools. As a second alternative, a wear-resistant cutting tool is provided having a cutting edge made of a composition comprising 34% to 51% cobalt, 25% to 32% chromium, 14% to 21% tungsten, 2% to 4% carbon, and one or more of the metals nickel, silicon, columbium, manganese and iron which, together, comprise no greater than 16% of the composition. This alternative cutting tool composition preferably comprises 43% to 48% cobalt, 28% to 32% chromium, tungsten and one or more the metals nickel, silicon, iron, manganese, columbium and carbon which, together, are present in an amount no greater than 29% of the composition. This alternative cutting tool may also be a pair of hand shears, a knife or similar tools.

Figure 1:
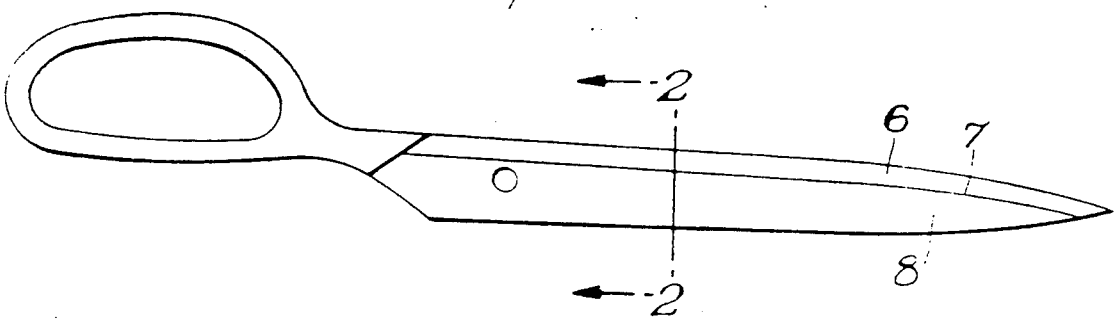
FIG. 1 is a schematic diagram of one component of a hand shear having a cutting edge of the composition according to the invention.

DETAILED DESCRIPTION OF THE INVENTION AND PREFERRED EMBODIMENTS WITH REFERENCE TO THE DRAWINGS

An improved cutting tool is provided, especially useful for hand shears. The cutting edge of the tool is made of a wear-resistant material of either: (a) 85% to 96% tungsten carbide and 15% to 4% cobalt, (b) 60% to 89% tungsten carbide, 4% to 28% tantalum carbide, 4% to 25% titanium carbide and 3% to 30% cobalt, or (c) 34% to 51% cobalt, 25% to 32% chromium, 14% to 21% tungsten, 2% to 4% carbon and one or more of the metals nickel, silicon, columbium, manganese and iron which, together, comprise no more than 16% of the material. For material "b", preferably the composition contains about 5% to 13% cobalt, 65% to 89% tungsten carbide, titanium carbide and tantalum carbide which, together, are present in an amount no greater than 30% of the composition of the material. For material "c", preferably the composition contains about 28% to 32% chromium, 43% to 48% cobalt, tungsten and one or more of nickel, silicon, iron, manganese, columbium and carbon which, together, are present in an amount no greater than 29% of the composition of the material.

According to the present invention, these materials may be attached to the edge of hand shears by cementing or brazing to form a cutting edge having superior properties. These materials provide hardness and a low coefficient of friction, are typified by the cobalt, chromium, tungsten, tantalum, titanium, and carbon family of materials. While many modifications and additions to these basic components are possible and appear desirable in a certain range of compositions, certain combinations of carbon, tungsten, titanium and tantalum with cobalt appear to be essential in order to achieve commerically acceptable results within the spirit of the present invention.

The tungsten and carbon alloy presents a hard, wear-resistant surface and the titanium and tantalum provide a low coefficient of friction. Cobalt is the principal wetting agent in these alloys and bonds these materials to form the required wear-resistant component.

Other elements in relatively small percentages, such as iron, silicon, nickel and molybdenum, may be included but are incidental to the manufacture of these alloys.

A range of compositions has been tested and those combinations, which are in the family known in the art as cemented tungsten carbides, appear to operate well in the present invention. Because many of these materials are available commercially, it should be appreciated that many of the tests have been conducted using these commercially available compositions for economic reasons.

These tests indicate certain limitations relating to the essential metals. For example, it appears that compositions including less than approximately 3% cobalt do not have sufficient strength to prevent chipping or cracking of the metal to form a tool of commerical usefulness. Further, as the percent of cobalt increases between 6% to about 13%, relatively good strength and wear-resistance is achieved. Also, it is noted that in tungsten carbide compositions having an increasing cobalt content between 13% and 25%, a reduced wear-resistance is found with high-impact strength.

The test data indicate that excellent wear-resistance and strength is achieved in the range of compositions which include 5% to 13% cobalt in tungsten carbide compositions.

In general, compositions of the cutting edge of the invention include, preferably, at least approximately 60% to 89% tungsten carbide, 4% to 28% tantalum carbide, 4% to 25% titanium carbide and 3% to 30% cobalt.

In view of the commercially available compositions within these general limits which heretofore were used for completely different purposes, there appears to be no significant advantages to be gained by employing tungsten carbide compositions containing a cobalt content much greater than 13%.

Shears made in accordance with this invention exhibit superior performance compared to conventional types of shears. Improvements in such performance criteria as edge wear and quality of cut have been observed. Such improvements are related to the fact that the invention provides for better edge strength, wear-resistance and coefficient of friction than has been possible previously.

The composition of the present invention has significant advantages compared to prior cutting edges. For example, the cutting edge composition can be varied within the scope of this invention to provide superior wear-resistance or to provide a greater degree of toughness, as required. This is particularly advantageous in the critical wear area when cutting abrasive material or when cutting high-strength materials.

The ease of control of the cutting edge composition permits a high quality shear to be manufactured. The strength and durability of the edge composition disclosed exhibits the desired wear-resistance and toughness and represents an unexpected and significant advance in hand shear construction. This advance is particularly evidenced by a comparison of the mode of shear edge wear between the product disclosed herein and prior commercially manufactured shears.

In a shear according to the present invention, the mode of edge wear is primarily individual particles flattening due to abrasion. It should be readily appreciated that, in such a cutting edge, the thousands of particles are being used to their fullest extent because the cobalt bonding agent is sufficiently strong to hold the particles in place and permit maximum utilization of the hard particles.

Actual comparisons to date of standard hand shears and hand shears according to the present invention indicate that shears according to this invention have a useful life span of 40 to 60 times greater than conventional hand shears subjected to substantially equivalent use conditions.

All percentages expressed herein are expressed as a weight percent basis.

The compositions according to the invention, generally, are made by conventional methods.

Cemented tungsten carbide is a product made by powder metals processing. The main stages in the manufacture of this material include: (1) Production of tungsten metal powder; (2) Preparation of tungsten carbide; (3) Preparation of alloyed and other carbides; (4) Addition of cobalt to produce grade powder; (5) Pressing; (6) Pre-sintering; and (7) Final sintering.

Tungsten oxide is reduced in hydrogen at a temperature of about 2000° F. to form tungsten metal powder which is relatively soft. Carbon or lamp black is added to the tungsten powder and this mixture is carburized in an induction furnace at approximately 2800° F. to form tungsten carbide powder.

Cobalt oxide is reduced in hydrogen at approximately 1800° F. to produce cobalt metal powder.

Titanium oxide and tantalum oxide are mixed with carbon or lamp black and are reduced and carburized in an induction furnace at approximately 3200° F. to produce titanium or tantalum carbide powder.

The above metals are the prime materials used to produce cemented tungsten carbide.

Selected powders are placed in a ball mill that contains acetone and is lined with cemented tungsten carbide and employs cemented tungsten carbide balls. The powders are crushed by the grinding action to produce a powder having a size range of 1–5 micrometers.

After ball milling for 3–5 days, the powder slurry is placed in trays and thoroughly dried. The powder is then screened and sifted through a series of fine metal screens to remove foreign matter and to remove oversize lumps.

Powders selected to produce a specific grade of cemented carbide are placed in blender and thoroughly mixed to obtain maximum strength and grade uniformity.

At this point in the process, the powders are ready for either hot pressing or cold pressing to form a final shape. Hot pressing is used primarily for the manufacture of larger carbide parts, and cold pressing is used for a variety of smaller parts.

In preparation for cold pressing, the dried powder is fed throug a hammer mill and wax is added to the powder during the hammer milling operation. The powder/wax combination is placed in an open-ended tumbling machine and tumbled until small spheres are formed. The spheres, slightly larger than grains of salt, are then used to fill the mold cavity for the cold pressing operation. The purpose of forming the spheres is to allow the mold cavity to fill evenly and equalize the powder density throughout the mold.

The pressed blanks are fed through a hydrogen atmosphere furnace at approximately 2000° F. and the wax is removed from the pressed blank. At this stage, the blanks have the strength of chalk and can be machined to form required angles or holes, or whatever is required in the final blank design.

The blank is placed in a vacuum or hydrogen atmosphere furnace and heated to approximately 2800° F. and, during this operation, the blanks assume their final size and hardness while shrinking from 20% to 30% of their original volume.

The hard metal blanks generally have a hardness ranging from 84 Rockwell A to 92.8 Rockwell A, depending on the size of the carbide particles and the percentage of cobalt binder used during the sintering operation.

The blank can be used in the sintered state or it can be machined by diamond grinding to form a desired surface finish. In order for the small carbide blank to be used effectively, it may be attached to a larger or heavier backing material such as a steel shank.

Techniques for securing the carbide blank to a steel shank include brazing, cementing or by mechanical fastening. The blade alignment necessary in this invention requires that the carbide edges be secured by brazing or cementing.

Brazing is one of the more common methods of securing carbide inserts to steel, and this is readily accomplished by the following steps: (1) Clean both mating surfaces; (2) Coat each mating surface with Handy Flux (product of Handy & Harmon Co.); (3) Position brazing shim approximately 0.003 inch thick between mating surfaces; and (4) Apply heat by hand torch or induction coil.

The most common brazing alloy used and approved by the American Welding Society is designated BAg3 having a brazing temperature in the range of 1270° F. to 1550° F. with a solidus temperature of 1170° F. The total braze thickness generally is 0.0015 inch to 0.0025 inch which gives a shear strength of 70,000 to 100,000 psi.

Use of adhesives or cement is another method used to secure carbide to a shank material, especially where operating temperature are low and where bond strength requirements are low. The most common adhesive is a two-part epoxy resin and these epoxy cements set completely in a few minutes at room temperature.

Hard, cemented tungsten carbide may be machined by several techniques. A very common method is by use of a diamond wheel. Excellent surface finish and sharp edges can be produced on cemented carbide by using proper wheel selection. Proper wheel selection involves wheel diameter, diamond mesh size, diamond concentration, bonding material, wheel speed, depth of cut, and use of sufficient coolant or no coolant.

The 8 to 10 AA surface finish required to produce the sharp cutting edge according to this invention is obtained by rough grinding with a 100-mesh resinoid diamond wheel and finish ground with a 220-mesh resinoid diamond wheel. To minimize heat buildup, a flood of coolant must be used during the rough and finish grinding.

Depth of cut or down feed using the 100-mesh diamond wheel should be 0.001 inches per cycle until the surface is clean. The final surface finish is generated with the 220-mesh diamond wheel using 0.001 inch depth of cut until the last 5 or 6 cycles when 0.0005 inch depth of cut should be used to generate the final surface finish of 8 to 10 AA.

The cutting edge according to this invention, as shown in FIG. 1, must be a smooth, continuous line that has no flaws along the edge. Relief angles of 0° F. to 65° F. included have been evaluated and, depending on what material is being cut, the relief angle should be modified to prevent edge damage.

The manufacture of material "a" and "b" has been described in the above paragraphs. The material classified as "c" is made by melting the ingredients in an electric furnace and chill casting in permanent molds to obtain the required blanks. The hardness of the chilled blanks ranges from 62 to 64 Rc. The blanks are attached to a steel shank by the same procedure as outlined for brazing of the cemented carbide blanks.

The blanks are easily machined by using 100- to 120-mesh aluminum oxide grinding wheels of a soft grade structure. Wheel speeds of 3800 to 4200 surface feet per minute and a depth of cut of 0.0015 to 0.0025 inches per cycle, along with a flood of coolant, will produce 10 to 12 AA surface finish.

Figure 2:
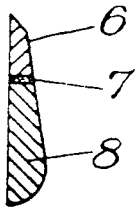
FIG. 2 is a cross-sectional view taken along line 2—2 of FIG. 1.

FIG. 1 shows one component of a set of hand shears made according to the invention. FIG. 2 is a cross-section taken along line 2—2 of FIG. 1 wherein edge 6 is affixed to shear component 8 by brazing or cement 7.

The examples which follow are intended to be illustrative of the invention but not to limit in any way the scope of the claims below.

EXAMPLE 1

A material composition was prepared according to the above procedures to produce a composition of 94% tungsten carbide and 6% cobalt. All percentages are by weight unless otherwise indicated. The specimens were affixed to shear handles by brazing and then finished by grinding to form the required cutting edge. The shears were used to cut yarns and fabrics of Kevlar ®, fiberglass and graphite. The shears cut these materials very satisfactorily.

EXAMPLE 2

A material composition was prepared according to the above procedures to produce a composition of the following proportions: 76% tungsten carbide, 12% titanium carbide, 4% tantalum carbide and 8% cobalt. The specimens were affixed to shear handles by brazing and finished by grinding to form the required cutting edge. The shears were used to cut yarns and fabrics of Kevlar ®, fiberglass and graphite. The shears cut these materials very satisfactorily.

EXAMPLE 3

A material composition was prepared according to the procedures outlined for material "c" to produce a composition having the following proportions: 48% cobalt, 31% chromium, 14% tungsten, 2% carbon, 2% columbium, 1% manganese and 2% iron. During the manufacture of this material, the chromium content was converted to chromium carbide which has good wear resistance and a low coefficient of friction. The material was machined to form a cutting edge and used to cut yarn and fabrics of Kevlar ®, fiberglass and graphite. The knife edge cut these materials very satisfactorily.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. In the method of cutting with an improved pair of hand shears, wherein the improvement comprises said shears having a cutting edge made of a composition consisting essentially of:

(a) 60% to 89% tungsten carbide,
(b) 4% to 28% tantalum carbide,
(c) 4% to 25% titanium carbide, and
(d) 3% to 30% cobalt.

2. The method of use of claim 1 wherein said composition consists essentially of:

(a) 65% to 89% tungsten carbide,
(b) 5% to 13% cobalt, and
(c) titanium carbide and tantalum carbide which, together, are present in an amount no greater than 30% of said composition.

3. In the method of cutting with an improved pair of hand shears, wherein the improvement comprises said shears having a cutting edge made of a composition consisting essentially of:

(a) 34% to 51% cobalt,
(b) 25% to 32% chromium,
(c) 14% to 21% tungsten,
(d) 2% to 4% carbon, and
(e) one or more of the metals nickel, silicon, columbium, manganese and iron which, together, comprise no greater than 16% of said composition.

4. The method of use of claim 3 wherein said composition consists essentially of:

(a) 43% to 48% cobalt,
(b) 28% to 32% chromium, and
(c) tungsten and one or more of the metals nickel, silicon, iron, manganese, columbium and carbon which, together, are present in an amount no greater than 29% of said composition.

5. In the method of cutting with an improved pair of hand shears, wherein the improvement comprises said shears having a cutting edge made of a composition consisting essentially of 85% to 96% tungsten carbide and 15% to 4% cobalt.

* * * * *